United States Patent [19]

Schwartz

[11] 4,247,097

[45] Jan. 27, 1981

[54] VARIABLE WEIGHT AEROBIC EXERCISE GLOVE

[76] Inventor: Leonard Schwartz, 3471 Fifth Ave., Pittsburgh, Pa. 15213

[21] Appl. No.: 16,399

[22] Filed: Mar. 1, 1979

[51] Int. Cl.[3] ..... A63B 21/12

[52] U.S. Cl. ..... 272/119; 272/125; 272/67; 273/DIG. 30

[58] Field of Search ..... 272/93, 67, 119, 116, 272/117, 125, 143; 2/159, 160, 162, 163, 161 A, 250, 251, 252; 273/54 B

[56] References Cited

U.S. PATENT DOCUMENTS

| | | | |
|---|---|---|---|
| 2,736,034 | 2/1956 | Fredenhagen et al. | 272/67 X |
| 3,149,839 | 9/1964 | Materia | 272/67 X |
| 3,369,258 | 2/1968 | Smith | 272/93 X |
| 3,490,766 | 1/1970 | Gardner | 272/67 X |
| 4,034,979 | 7/1977 | Wester | 272/119 X |

*Primary Examiner*—Richard C. Pinkham
*Assistant Examiner*—William R. Browne
*Attorney, Agent, or Firm*—Buell, Blenko, Ziesenheim & Beck

[57] ABSTRACT

A weight glove is provided having front and back palm, wrist and finger enclosing pieces and thumb enclosing pieces, said front and back pieces extending over the wrist of a wearer and being open to receive a wearer's hand, a fastener for removably fastening said glove to the wearer's hand, a pocket in the front enclosing piece at the palm thereof removably receiving a palm weight, a first pocket on the dorsal portion of the back piece removably receiving at least one selected flexible conforming weight, at least one generally flexible conforming weight in said pocket, a second pocket on the back piece overlying a wearer's wrist, and generally flexible conforming weight in said second pocket.

6 Claims, 4 Drawing Figures

Fig. 1.
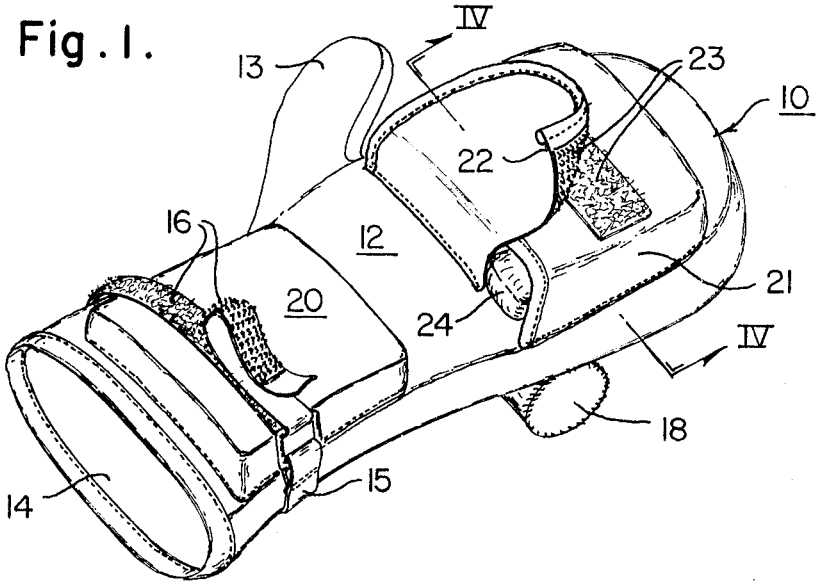
Fig. 2.
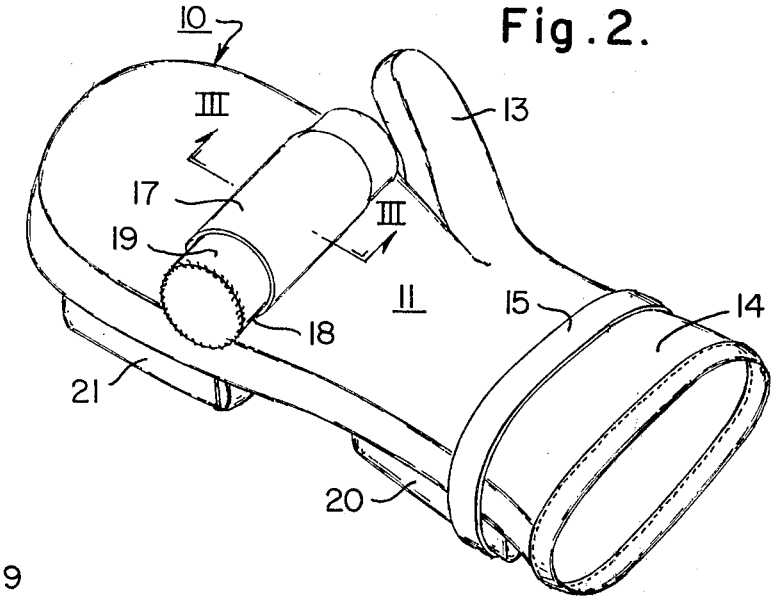
Fig. 3.
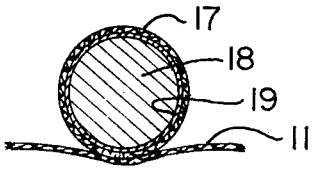
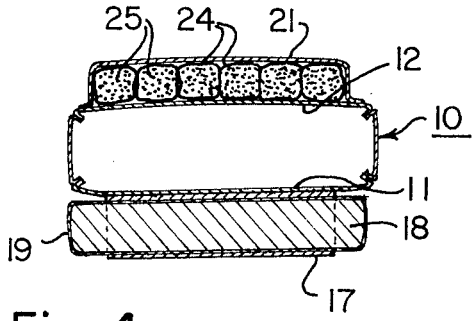
Fig. 4.

VARIABLE WEIGHT AEROBIC EXERCISE GLOVE

This invention relates to weight gloves and particularly to a variable weight glove having variable dorsal and palm weights, especially useful in connection with so-called aerobic exercises such as walking, running, dancing, etc.

Aerobic exercise has been found to be highly effective in training the body, i.e., heart muscle and skeletal muscal ensemble, to utilize oxygen at a higher rate. As a result, running, jogging and walking have taken on a new dimension in the world of physical fitness. I have found that this training effect may be augmented to a surprising degree by encumbering the limbs of the exercisor. Hand-held weights serve this purpose very well, however, the limiting factor in their use is the gripping power of the hand which tends to fatigue before the large muscle masses of the arm and leg. Aerobic exercises, by their very nature, are prolonged in duration, frequently extending over periods in excess of an hour. The limiting factor of gripping power is thus a very real and significant one for such exercises. The use of wrist weights and ankle weights has also been suggested, however, in the case of wrist weights particularly, the effective lever arm is enhanced by placing the weights in or on the hands. Moreover, the comfort factor is not to be discounted and wrist weights can be and frequently are uncomfortable and tend to chafe the wearer.

I have invented a weight glove which is weighted in such a manner that it is balanced well for a variety of movements typical of aerobic exercise and in which the weights are adjustable up to a substantially greater mass than any wrist or hand weights now available for such exercise.

I provide a weight glove to be worn on each hand comprising a glove formed from front and back palm and finger enclosing pieces and thumb enclosing pieces, said front and back pieces extending over the wrist and being open to receive the wearer's hand, means for removably fastening said glove to the wearer's hand, a pocket in the front enclosing pieces at the palm removably receiving a palm weight, a first pocket on the dorsal portion of the back piece removably receiving selected weight means, generally conforming weight means in said pocket, a second pocket on the back piece overlying a wearer's wrist, and generally conforming weight means in said second pocket. Preferably the glove is of mitten form and made of fabric (e.g., duck, canvas, etc.), leather or one of the synthetic leather-like materials, such as Naugahyde (T.M.). The palm weight is preferably a cylindrical elongate weight held in an elongate loop in the front enclosing piece of the glove. The first pocket is preferably provided with a closure member held to the pocket with a Velcro fastener. The second pocket is preferably permanently filled and closed but may be provided with a closure member and removable weights. The weights in the first and second pockets are preferably fine lead shot contained in a plurality of separate bags for easy removal and adjustment of the weight contained in the pocket. Preferably the second pocket is placed on the wrist portion behind the thumb enclosing piece and slightly offset from the first dorsal pocket. The means for fastening the glove to the wearer's hand is preferably a strap with a Velcro fastener, permitting adjustment for size.

In the foregoing general description, I have set out certain objects, purposes and advantages of my invention. Other objects, purposes and advantages of the invention will be apparent from a consideration of the following description and the accompanying drawings in which:

FIG. 1 is an isometric view, partly broken away, of a weight glove according to my invention viewed from the back;

FIG. 2 is an isometric view of a weight glove according to my invention viewed from the front or palm;

FIG. 3 is a fragmentary section on the line III—III of FIG. 2; and

FIG. 4 is a fragmentary section on the line IV—IV of FIG. 1.

Referring to the drawings, I have illustrated a preferred embodiment of the present weight glove 10, in right hand form. The left hand form is the mirror image. Each glove has a front 11 and back 12 palm and finger enclosing pieces and a thumb enclosing piece 13 sewed together to form a mitten type hand covering which extends back over the wrist of the wearer to form a wrist band portion 14. The wrist band portion 14 carries a strap 15 with cooperating Velcro fastener 16 by means of which the glove may be held in place on the hand. The palm of the front piece 11 is provided with an elongate loop 17 adapted to slidingly receive a cylindrical, preferably solid, metal weight 18 enclosed in a cloth cover 19 which aids in frictionally holding the weight in loop 17.

A pocket 20 is provided on the wrist band portion 10, preferably closed, and containing a plurality of weight bags with small shot or like weight particles.

A second pocket 21 is provided on the distal portion of the finger area of glove 10. This pocket is preferably provided with a flap cover 22 which is held in place by Velcro fastener 23 to retain interchangeable bags 24 of weight particles 25 such as fine lead shot. The bags 24 may be removed or added to so as to change the weight in pocket 21.

The two pockets 20 and 21 are preferably offset from each other as shown in FIG. 1 so that the pocket 20 wraps around the wrist behind the thumb portion 13 and the pocket 21 extends across substantially the distal portion of the glove.

The glove of this invention can comfortably accommodate greater mass than any wrist or hand weights now available and by moving the glove's center of gravity closer to the end of the upper extremity provides both a great biomechanical negative advantage and comfort which in turn provides the possibility of heavy exercise of longer duration. The attached palm bar or grip increases the possible duration of exercise sessions since the performer may opt to relinquish the "isometric" grip on the bar intermittenly or entirely and thus avoid the harmful limiting factor which gripping a weight represents. The presence of the grip provides, on the other hand, both comfort and increased strength to the hand and forearm musculature, without being obligatory.

In the foregoing specification, I have set out certain preferred embodiments of my invention, however, it will be understood that this invention may be otherwise embodied within the scope of the following claims.

I claim:

1. A weight glove comprising a glove formed from front and back palm, wrist and finger enclosing pieces and thumb enclosing pieces, said front and back pieces extending over the wrist of a wearer covering the dorsal and palm portions of the hand respectfully and being open to receive a wearer's hand, means for removably fastening said glove to the wearer's hand, pocket means in the front enclosing piece at the palm covering portion thereof removably receiving a solid elongate palm weight, around which the hand may be closed, a solid elongate palm weight in said pocket means extending substantially across the entire width of the palm, a first pocket on the dorsal portion of the back piece removably receiving selected flexible conforming weight means capable of conforming in use to the shape of the dorsal portion of the hand, generally flexible conforming weight means adapted to fit said first pocket, a second pocket on the back piece overlying a wearer's wrist, and generally flexible conforming weight means in said second pocket conforming in use to the shape of the wearer's wrist.

2. A weight glove as claimed in claim 1 wherein said glove is a mitten.

3. A weight glove as claimed in claim 1 or 2 wherein said palm weight is a solid cylindrical metal member.

4. A weight glove as claimed in claim 1 or 2 wherein said first and second pockets are provided with openable closure means whereby the weight means contained therein may be changed.

5. A weight glove as claimed in claim 1 or 2 wherein the flexible conforming weights are a plurality of bags of metal shot.

6. A weight glove as claimed in claim 1 or 2 wherein the means for fastening the glove on the wearer's hand is a strap with Velcro fastener.

* * * * *